US005709353A

United States Patent [19]

Cattaneo et al.

[11] Patent Number: 5,709,353

[45] Date of Patent: Jan. 20, 1998

[54] WINDING DEVICE FOR FORMING AN ELECTRIC COIL ON A MAGNETIC CIRCUIT WITH AN AIR-GAP

[75] Inventors: Frédéric Cattaneo, Monnetier-Mornex; Régis Mentzer, Vetraz-Monthoux, both of France; Pierre Strubin, Bellevue-Geneve, Switzerland

[73] Assignee: Liaisons Electroniques-Mecaniques LEM S.A., Geneva, Switzerland

[21] Appl. No.: 691,688

[22] Filed: Aug. 2, 1996

[30] Foreign Application Priority Data

Aug. 4, 1995 [CH] Switzerland ..... 2266/95

[51] Int. Cl.[6] ..... H01F 41/06

[52] U.S. Cl. ..... 242/439.5; 242/441.1; 242/444; 242/447.1

[58] Field of Search ..... 242/439, 439.5, 242/437.2, 437.1, 441.1, 443, 447.1, 434, 444; 29/605

[56] References Cited

U.S. PATENT DOCUMENTS

| | | | |
|---|---|---|---|
| 2,773,651 | 12/1956 | Whipple | 242/439 |
| 2,777,116 | 1/1957 | Gordon | 242/434 |
| 3,128,056 | 4/1964 | Fahrbach | 242/437.1 |
| 4,417,699 | 11/1983 | Skrobisch . | |
| 4,529,138 | 7/1985 | Perschka | 242/439.5 |
| 4,782,582 | 11/1988 | Venezia . | |
| 4,946,112 | 8/1990 | Nelle et al. | 242/439 |
| 5,032,846 | 7/1991 | Lea et al. | 242/437.1 |

*Primary Examiner*—Katherine Matecki

*Attorney, Agent, or Firm*—Clifford W. Browning; Woodard, Emhardt, Naughton Moriarty & McNett

[57] ABSTRACT

For forming a cylindrical coil (3) on a rectilinear arm of a magnetic circuit (1) having a very small air-gap (2), a wire guide member (6) has a wire inlet portion (8), a wire outlet portion (9) and an elongated intermediary portion (11) arranged for effecting a rotary movement about the axis (4) of the coil (3) and a reciprocating movement in the axial direction of the coil (3). The intermediary portion of the wire guide member has, over a length at least equal to that of the coil to be formed, a height smaller than the length of the air-gap so that it can move through the air-gap in the longitudinal and in the transverse directions.

8 Claims, 3 Drawing Sheets

WINDING DEVICE FOR FORMING AN ELECTRIC COIL ON A MAGNETIC CIRCUIT WITH AN AIR-GAP

FIELD AND BACKGROUND OF THE INVENTION

The present invention relates to a winding device for forming a substantially cylindrical electric coil on a substantially rectilinear arm of a magnetic circuit having an air-gap of a very small length as compared to the length of the magnetic circuit, said air-gap crossing the magnetic circuit in a direction substantially parallel to said linear arm.

The invention further relates to a winding device for forming an electric coil on a magnetic circuit of substantially toroidal shape having an air-gap of a very small length as compared to the length of the magnetic circuit.

The prior art winding methods for forming coils on magnetic circuits having a very small air-gap require, as in the case of entirely closed circuits, the use of auxiliary wire carriers, for example of an annular member with a slit, or the coils are associated with laminated magnetic circuits which are capable of being temporarily deformed so that a prefabricated coil can be placed on the circuit. The known methods are complicated and limited in their application and they lead to high costs either directly or indirectly due to the use of alternative solutions rather than the forming of the coils on the circuit.

It is an object of the present invention to provide a winding device by which coils can be formed directly on a magnetic circuit of the above mentioned type in a very economic way and so as to be applicable to manufacturing in large series. The invention aims in particular to allow the use of magnetic circuits formed from a magnetic rod or wire, by which the overall cost of the product will be further reduced.

According to the invention, for forming a coil on a substantially rectilinear branch of a magnetic circuit, the winding device comprises at least one rigid wire guide member having a wire inlet portion, a wire outlet portion and an elongated intermediary portion extending in a direction substantially parallel to the axis of the coil to be formed, the distance of said intermediary portion to said coil axis being equal to the distance between said air-gap and said axis, said intermediary portion having, in longitudinal section, over a length at least equal to the length of said coil, a height smaller than the length of said air-gap, so that said intermediary portion is capable of passing through said air-gap in the longitudinal and in the transverse directions, said winding device further comprising a carrier device for said wire guide member and a magnetic circuit supporting device arranged so that said wire guide member and said magnetic circuit are capable of effecting, with respect to each other, a rotary movement about the axis of said coil and a reciprocating movement in the axial direction of said coil.

In the case of a magnetic circuit of substantially toroidal shape, the winding device according to the invention comprises at least one rigid wire guide member having a wire inlet portion, a wire outlet portion and an elongated intermediary portion, the latter having in cross-section a height such that said intermediary portion is capable of turning in the plane of the magnetic circuit while passing through the air-gap, by an angle at least equal to the angle formed by two planes defined, respectively, by the ends of said coil to be formed on the magnetic circuit, said winding device further comprising a carrier device for said wire guide member and a magnetic circuit supporting device arranged so that said wire guide member and said magnetic circuit are capable of effecting, with respect to each other, a rotary movement about the instantaneous axis of said coil, a pivoting movement in the plane of the magnetic circuit, substantially about the air-gap and a reciprocating movement in the longitudinal direction of said intermediary portion of the wire guide member.

Further characteristics and objects of the invention will become apparent from the following description of preferred embodiments indicated by way of example and represented in the attached drawings.

DESCRIPTION OF PREFERRED EMBODIMENTS

Figure 1:
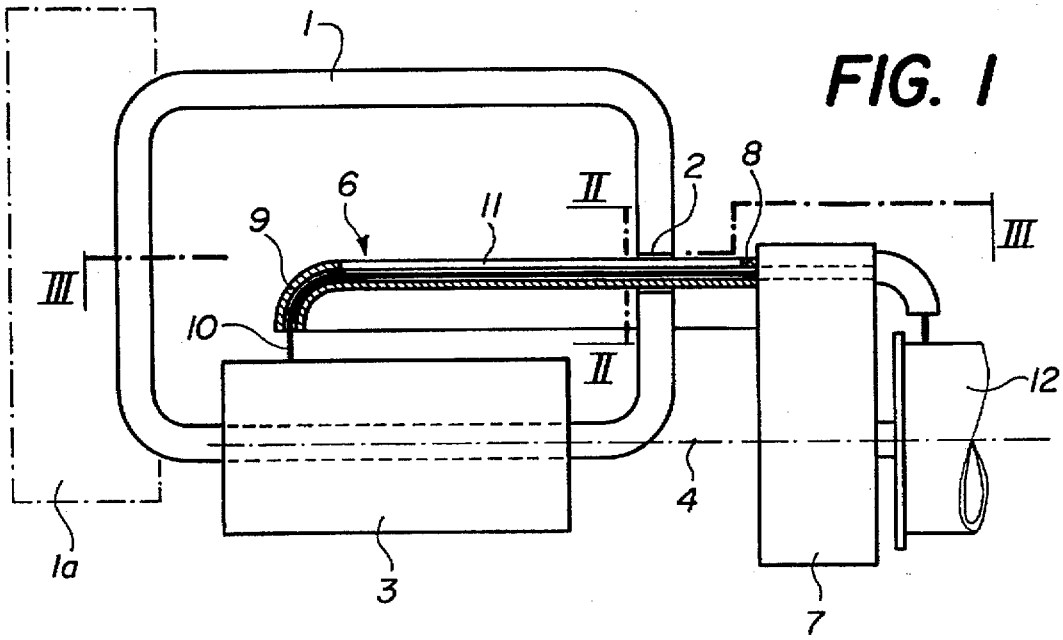
FIG. 1 is a side view of the main parts of a winding device according to the invention for forming a coil on a rectilienar arm of a magnetic circuit.

FIG. 1 shows a magnetic circuit 1 with an air-gap 2 and an electric coil 3 being formed on a rectilinear arm of the circuit 1 around an axis designated by 4. This magnetic circuit is fixed in a usual way on a supporting device 1*a*, schematically shown in FIG. 1 by a box in dashed lines. A wire guide 6 is arranged so as to pass through the air-gap 2 in the operational state illustrated by FIG. 1. This wire guide is mounted on a carrier device 7 which is arranged for rotation about an axis in line with axis 4, during the winding process.

The wire guide 6 comprises a wire inlet portion 8 in the vicinity of the support 7 and, at its free end, a wire outlet portion 9 guiding the wire represented by 10 to lead the same towards the coil 3 to be formed, in a plane perpendicular to the axis 4 of the same. Between these two end portions of the wire guide 6, extends an intermediary portion 11 the length of which is greater than the length of the coil 3. Along this intermediary portion 11, the wire is guided between the portions 8 and 9. FIG. 1 further shows a wire spool 12 mounted on the support 7 so as to be capable of rotating about an axis in line with axis 4 in the shown example. Such an arrangement of spool 12 is used for relatively thick wire. When the wire to be wound is relatively thin, the feeding of the wire guide 6 can be effected from an independent wire supply from which the wire is preferably guided along the axis of rotation which is, in the present case, the axis 4.

Figure 2:
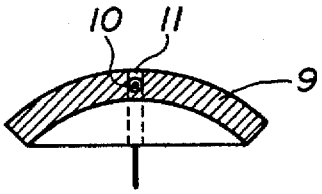
FIG. 2 is a sectional view along line II—II of FIG. 1.

FIG. 2 shows the shape of the wire guide 6 in its intermediary portion 11 which is defined in its cross-section by two concentric arcs of circles having a common center on the axis 4. In the embodiment shown in FIG. 2, the wire 10 passes in an open groove between the portions 8 and 9 of the wire guide.

Figure 3:
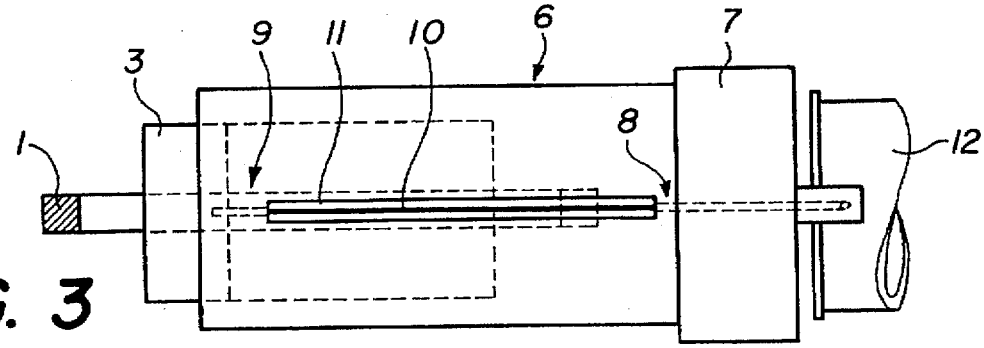
FIG. 3 is a top view, partially in section, along the line III—III of FIG. 1.

FIG. 3 shows in particular the wire guide 6 in a top view of FIG. 1. The various parts are designated by the same reference numerals as in FIG. 1.

As shown in FIGS. 1 to 3, the wire guide 6 has a rather small height in its intermediary portion which crosses the air-gap 2. The rigidity of the wire guide is obtained by its general shape of a sector of a cylinder and by the shape of its free end portion 9.

The support of the magnetic circuit 1 and the carrier of the wire guide 6 are arranged so that the magnetic circuit and the wire guide can effect two simultaneous movements with respect to each other, namely a rotary movement about the axis 4 and a translatory movement in the longitudinal direction of the wire guide over the length of coil 3.

To bring the wire guide in its working position before the winding operation, the wire guide and the magnetic circuit are shifted, with respect to each other, in the direction of the axis of the coil, while the wire guide is placed in an angular position in which it is entirely outside of the air-gap.

Figure 4:
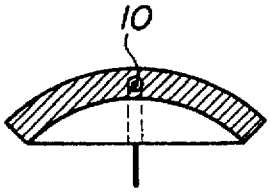
FIGS. 4 and 5 are sectional views similar to those of FIG. 2 showing alternative embodiments of a wire guide for the device of FIG. 1.
Figure 5:
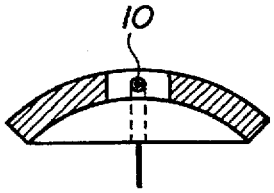

In the embodiments of the wire guide as illustrated in FIGS. 4 and 5, the intermediary portion comprises, respectively, a channel for guiding the wire and an open portion at the ends of which the wire is guided through a channel similar to that of FIG. 4.

Figure 6:
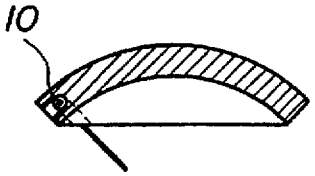
FIGS. 6 and 7 are, respectively, a front view and a side view of another embodiment of a wire guide for the device of FIG. 1.
Figure 7:
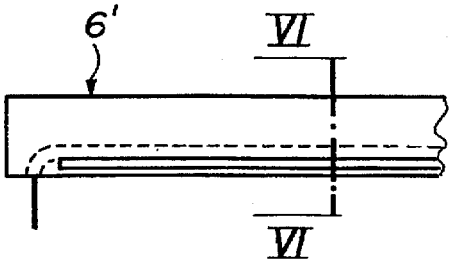

FIG. 6 shows in a similar way the guiding of a wire in a groove at the edge of the intermediary portion of the wire guide, while FIG. 7 shows a part of such a wire guide 6 in a partial lateral view.

Figure 8:
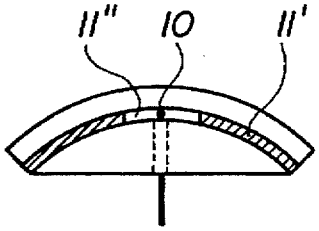
FIGS. 8, 9 and 10 are, respectively, a front view partially in section along line VIII—VIII of FIG. 9, a side view partially in section, and a top view, of still another embodiment of a wire guide for the device of FIG. 1.
Figure 9:
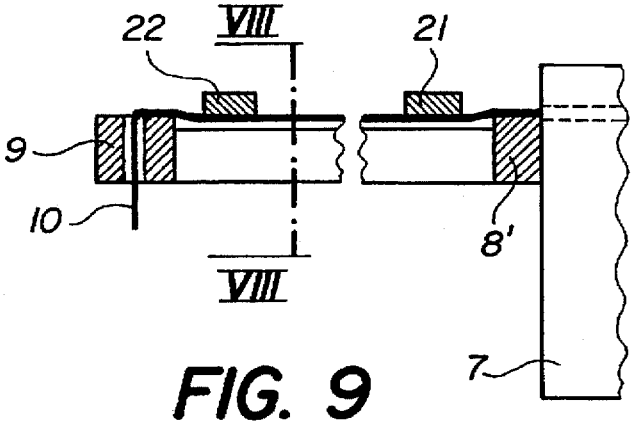
Figure 10:
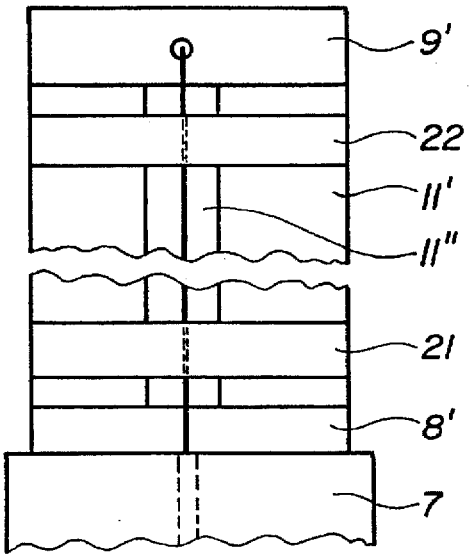

FIGS. 8, 9 and 10 relate to an embodiment of a wire guide allowing the winding onto a magnetic circuit having an air-gap of minimum length. As shown in particular in FIG. 8, the intermediary portion 11' can in such an embodiment have a height which is substantially equal to the thickness of the wire 10 which passes through an opening 11" over the whole length of the intermediary portion 11'. The wire 10 is guided at the inlet and at the outlet of the intermediary portion by parts 21 and 22 which cooperate with wire inlet and outlet portions 8' and 9", respectively. FIG. 10 shows such a wire guide from below, similar parts to those of FIGS. 8, 9 and 1 to 3 being designated by the same reference numerals.

Figure 11:
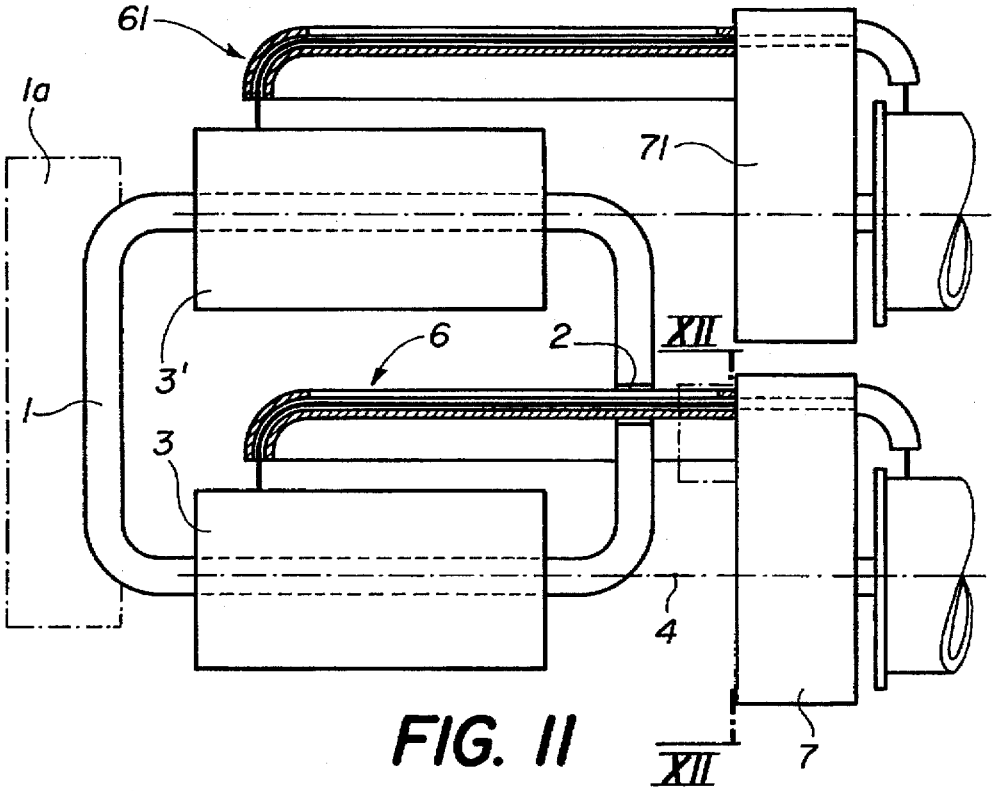
FIG. 11 is a view similar to that of FIG. 1, showing a device for forming simultaneously two coils on a magnetic circuit.
Figure 12:
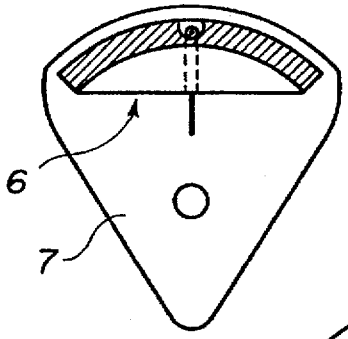
FIG. 12 is a view, partially in section, along line XII—XII of FIG. 11.

FIG. 11 shows a device for forming simultaneously two coils 3 and 3' on parallel arms of a magnetic circuit 1, the air-gap of which is situated in a plane of symmetry between the two coils. The wire guides 6 and 61 have the shapes described above and are driven to rotate, respectively, about axes 4 and 4' of the coils to be formed. The rotation is effected at the same speed, in the same direction or in opposite directions, but with an angular shifting of 180° with reference to the passage through the air-gap so that the wire guides 6 and 61 cross the air-gap 2 alternately. The respective carriers 7 and 71 and the support 1*a* of the magnetic circuit are further arranged for effecting a relative reciprocating movement in the axial direction of the coils. FIG. 12 shows, in a front view, the shape of a support 7 or 71 which allows the above mentioned rotations in phase opposition. In such a device, the total time required for the winding can be reduced by one half.

Figure 13:
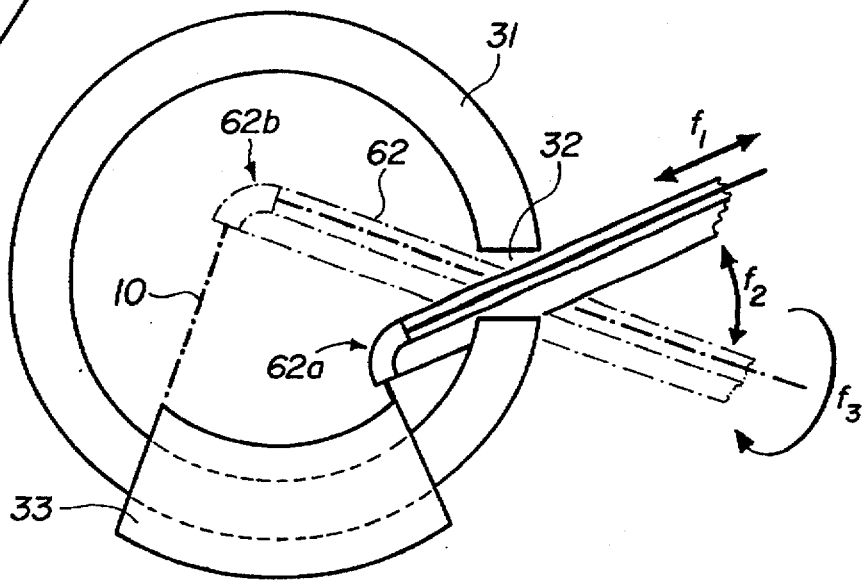
FIG. 13 is a schematical view illustrating the operation of a device according to the invention for forming a coil on a toroidal magnetic circuit.

The present device can also be adapted for winding coils on magnetic circuits of toroidal shape in which the air-gap can have a relatively short length. As shown in FIG. 13, a wire guide 62 is arranged so that its intermediary portion crosses the air-gap 32 of a magnetic circuit 31 for forming at least one coil 33 on that circuit, in a similar way to the case of a circuit with linear coil supporting arms. However, in the case of a toroidal circuit, the wire guide 62 further effects a pivoting movement in the plane of the circuit about the center of the air-gap 32. A second coil, not shown, can also be formed on a portion of the circuit 31, diametrally opposite to the first coil, in a similar way as that described in relation with FIG. 11. Two end positions of the wire guide 62 are shown in FIG. 13 and are designated by 62*a* and 62*b*. The arrows $f_1$, $f_2$ and $f_3$ indicate the different components of the movement of this wire guide with respect to the circuit 31.

It will be understood from the above that the device according to the invention makes it possible to produce coils at a high rate in manufacturing great series so that the cost price of the manufactured product can be considerably reduced as compared to that of the presently available methods. In particular, it can be used for manufacturing electromagnets, current or voltage transformers with air-gap, current sensors using a Hall effect cell placed in an air-gap, electrovalves, air-gap relays, contactors or linear or angular actuators.

What is claimed is:

1. A winding device for forming a substantially cylindrical electric coil, having an axis, on a substantially rectilinear arm of a magnetic circuit having an air-gap of a very small length as compared to the length of the magnetic circuit, said air-gap crossing the magnetic circuit in a direction substantially parallel to said rectilinear arm, said winding device comprising at least one rigid wire guide member having a wire inlet portion and a wire outlet portion and an elongated intermediary portion extending in a direction substantially parallel to the axis of the coil to be formed, the distance from said intermediary portion to said coil axis being equal to the distance between said air-gap and said axis, said intermediary portion having a cross-section such that said intermediary portion can pass through said air-gap when said wire guide member and said magnetic circuit are effecting, with respect to each other, a rotary movement about said coil axis and a reciprocating movement in the axial direction of said coil, said wire guide member being mounted in the vicinity of its wire inlet portion on a carrier device and said magnetic circuit being supported by a supporting device, at least one of said carrier device and said supporting device being arranged for having said wire guide member and said magnetic circuit effect said rotary and reciprocating movements with respect to each other.

2. A device according to claim 1, wherein said carrier device for said wire guide member comprises a support for a wire supply spool, arranged so that the axis of rotation of said spool and the axis of the coil are in line.

3. A device according to claim 1, wherein said intermediary portion of the wire guide member has a cross-section determined by two arcs of concentric circles having their common center on the line of the axis of the coil and being radially spaced from each other by a distance smaller than the length of the air-gap, said intermediary portion comprising a channel of closed cross-section for guiding the wire in a direction parallel to the axis of the coil.

4. A device according to claim 1, wherein said intermediary portion of the wire guide member has a cross-section determined by two arcs of concentric circles having their common center on the line of the axis of the coil and being radially spaced from each other by a distance smaller than the length of the air-gap, said intermediary portion comprising a groove for guiding the wire in a direction parallel to the axis of the coil.

5. A device according to claim 1, wherein said intermediary portion of the wire guide member has a cross-section determined by two arcs of concentric circles having their common center on the line of the axis of the coil and being radially spaced from each other by a distance smaller than the length of the air-gap, and wherein said intermediary portion comprises, in its longitudinal direction an opening of a length at least equal to that of the coil to be formed, the wire inlet and outlet portions being arranged for guiding the wire, so that the wire extends in said opening inside the space defined by said arcs of circles.

6. A winding device according to claim 1, further comprising a second wire guide member mounted on a second carrier device, said first and second carrier devices being arranged so that said wire guide members effect a rotary movement about the axes of the two coils, respectively, at the same speed but with an angular shift of 180° when passing through said air-gap, whereby two coils are simultaneously formed on opposite arms of the magnetic circuit.

7. A winding device for forming an electric coil on a magnetic circuit of substantially toroidal shape having an air-gap of a very small length as compared to the length of the magnetic circuit, said winding device comprising at least one rigid wire guide member having a wire inlet portion, a wire outlet portion and an elongated intermediary portion, the latter having a cross-section such that said intermediary portion is capable of turning in the plane of the magnetic circuit while passing through the air-gap, by an angle at least equal to the angle formed by two planes defined, respectively, by the ends of said coil to be formed on the magnetic circuit, said wire guide member being mounted in the vicinity of its wire inlet portion on a carrier device and said magnetic circuit being supported by a supporting device, at least one of said carrier device and said supporting device being arranged for having said wire guide member and said magnetic circuit effect, with respect to each other, a rotary movement about an instantaneous axis of said coil, a pivoting movement substantially about the air-gap of said magnetic circuit and a reciprocating movement in the longitudinal direction of said intermediary portion of the wire guide member.

8. A winding device according to claim 7, further comprising a second wire guide member mounted on a second carrier device, said first and second carrier devices being arranged so that said wire guide members effect a rotary movement about the axes of the two coils respectively, at the same speed but with an angular shift of 180° when passing through said air-gap, whereby two coils are simultaneously formed on opposite arms of the magnetic circuit.

* * * * *

UNITED STATES PATENT AND TRADEMARK OFFICE

CERTIFICATE OF CORRECTION

PATENT NO. :5,709,353
DATED :Jan. 20,1998
INVENTOR(S) :Frederic Cattaneo, et al

It is certified that error appears in the above-identified patent and that said Letters Patent is hereby corrected as shown below:

Column 3, line 35, delete "6" and insert –6'--

Signed and Sealed this

Second Day of June, 1998

*Attest:*

*Attesting Officer*

BRUCE LEHMAN

*Commissioner of Patents and Trademarks*